US011318490B2

(12) United States Patent
Carta

(10) Patent No.: US 11,318,490 B2
(45) Date of Patent: May 3, 2022

(54) DISPENSER FOR DISPENSING A FLUID

(71) Applicant: APTAR ITALIA S.P.A., San Giovanni Teatino (IT)

(72) Inventor: Lamberto Carta, Pescara (IT)

(73) Assignee: APTAR ITALIA S.P.A., San Giovanni Teatino (IT)

( * ) Notice: Subject to any disclaimer, the term of this patent is extended or adjusted under 35 U.S.C. 154(b) by 0 days.

(21) Appl. No.: 17/311,202

(22) PCT Filed: Oct. 25, 2019

(86) PCT No.: PCT/IB2019/059165
§ 371 (c)(1),
(2) Date: Jun. 4, 2021

(87) PCT Pub. No.: WO2020/128658
PCT Pub. Date: Jun. 25, 2020

(65) Prior Publication Data

US 2022/0001408 A1 Jan. 6, 2022

(30) Foreign Application Priority Data

Dec. 21, 2018 (IT) ..... 102018000020692

(51) Int. Cl.
*B05B 11/00* (2006.01)

(52) U.S. Cl.
CPC ..... *B05B 11/3033* (2013.01); *B05B 11/0044* (2018.08); *B05B 11/3035* (2013.01); *B05B 11/3059* (2013.01); *B05B 11/0089* (2013.01); *B05B 11/3047* (2013.01)

(58) Field of Classification Search
CPC ..... B05B 11/3033; B05B 11/0044; B05B 11/3035; B05B 11/3059; B05B 11/0089; B05B 11/3047
See application file for complete search history.

(56) References Cited

U.S. PATENT DOCUMENTS 5,014,881 A * 5/1991 Andris ..... B05B 11/3035 222/207
5,664,703 A 9/1997 Reifenberger et al.
7,111,761 B2 * 9/2006 Masuda ..... B05B 11/3035 222/321.7

(Continued)

OTHER PUBLICATIONS

International Search Report for PCT/IB2019/059165 dated Feb. 12, 2020, 3 pages.

(Continued)

*Primary Examiner* — Jeremy Carroll
(74) *Attorney, Agent, or Firm* — Nixon & Vanderhye

(57) ABSTRACT

Described is a dispenser for dispensing a fluid, made of plastic material, including: —a ring nut having an inner cylindrical wall equipped with partial grooves; —a concertina-like deformable element, defining a return spring of the dispenser and including a cylindrical lower projection equipped with relative partial grooves; —a ring designed to define with the ring nut a locking system designed to define an operating configuration and a non-operating configuration of the dispenser in such a way as to pull the concertina-like deformable element in such a way as to align the partial grooves of the cylindrical wall of the ring nut and the partial grooves of the concertina-like deformable element.

20 Claims, 6 Drawing Sheets

(56) References Cited

U.S. PATENT DOCUMENTS

| | | | | |
|---|---|---|---|---|
| 2008/0083784 | A1 | 4/2008 | Foster et al. | |
| 2010/0102090 | A1* | 4/2010 | Hummel | B05B 11/0029 222/153.13 |
| 2010/0116849 | A1* | 5/2010 | Lautre | B05B 11/3033 222/153.13 |
| 2012/0024904 | A1* | 2/2012 | Doulin | B05B 11/3035 222/207 |

OTHER PUBLICATIONS

Written Opinion of the ISA for PCT/IB2019/059165 dated Feb. 12, 2020, 5 pages.

* cited by examiner

DISPENSER FOR DISPENSING A FLUID

CROSS-REFERENCE TO RELATED APPLICATIONS

This application is the U.S. national phase of International Application No. PCT/IB2019/059165 filed Oct. 25, 2019 which designated the U.S. and claims priority to IT 102018000020692 filed Dec. 21, 2018, the entire contents of each of which are hereby incorporated by reference.

BACKGROUND OF THE INVENTION

Field of the Invention

This invention relates to a dispenser for dispensing a fluid. In other words, the invention relates to a dispensing device applicable to the neck of a bottle in order to dispense the fluid contained in the bottle.

Description of the Related Art

There are various types of prior art dispensers, from those which are structurally complex to those which are structurally simpler.

Generally speaking, the use of dispensers is known which are equipped with a simple structure and therefore with a reduced number of components so as to have environmentally-sustainable products equipped with homogeneous material in such a way as to simplify the recycling.

Disadvantageously, these devices are made of materials different from those of the bottles to which they are coupled and a user who is not very careful might not separate the dispenser from the bottle when disposing of the waste. In this way the recycling of the two components is not efficient and, especially when arriving in an area for sorting the waste, requires lengthy sorting times.

Moreover, from a functional point of view of the dispensers, a further drawback is linked to the simplified nature of the structure of the dispensers. In effect, the dispensers are based on elements which can be deformed in a concertina fashion which act as a spring and delimit the dosing chamber for the product flowing out.

These elements also include the inlet and outlet valves and can conveniently open for specific pressure differences.

Disadvantageously, these elements do not have compensating systems and are not therefore able to top-up the volume of product extracted from the bottle as they are generally used for systems which do not require it.

Moreover, prior art dispensers require certain construction specifications in order to allow the transport in safety, which is a feature disadvantageously missing in the above-mentioned simplified structures.

SUMMARY OF THE INVENTION

The technical purpose of the invention is therefore to provide a dispenser for dispensing a fluid which is able to overcome the drawbacks of the prior art.

The aim of the invention is therefore to provide a dispenser for dispensing fluid which has a simplified structure which can be used in systems which require the presence of a compensation system for topping-up the volume of product extracted.

A further aim of the invention is to provide a dispenser for dispensing fluid which has a degree of robustness such that it can be dispatched without particular protective devices.

A further aim of the invention is to provide a dispenser for dispensing fluid which has features such as to allow recycling in a safe fashion.

The technical purpose indicated and the aims specified are substantially achieved by a dispenser for dispensing a fluid comprising the technical features disclosed and claimed.

In particular, the technical purpose specified and the aims specified are substantially achieved by a dispenser for dispensing a fluid, made of plastic material.

The dispenser comprises a ring nut which can be screwed on the neck of a bottle and comprising an orifice for sucking fluid from the bottle, a series of holes positioned around the orifice and an inner cylindrical wall equipped with partial grooves.

The dispenser also comprises a concertina-like deformable element, defining a return spring of the dispenser, comprising a cylindrical lower projection equipped with relative partial grooves and a dome-shaped element which rests on the orifice of the ring nut, and side walls defining a dosing chamber of the dispenser.

The dome-shaped element constitutes an inlet valve for the product and is designed to rise in the case of negative pressures of the dosing chamber.

The concertina-like deformable element also comprises an upper portion equipped with a sealing lip designed to open in the case of a pressure of the dosing chamber greater than a predetermined threshold value.

The dispenser also comprises a ring positioned on the ring nut and designed to define with the ring nut a locking system designed to define an operating configuration, in which the dispenser can be actuated, and a non-operating configuration of the dispenser, in which the dispenser cannot be actuated, by means of a reciprocal rotation of the ring and the ring nut.

The ring is also coupled to the upper portion of the concertina-like deformable element in such a way as to make, by means of the sealing lip and suitable openings of the ring, an outlet valve of the dispenser and in such a way as to pull the concertina-like deformable element during the reciprocal rotation in such a way as to align or misalign the partial grooves of the cylindrical wall of the ring nut and the partial grooves of the concertina-like deformable element in such a way as to open or close, respectively, a passage through which the outside air can enter into the bottle through a conduit which is separate and different to the conduit for dispensing the product, for compensating the reduction in the volume of liquid in the bottle as it is gradually emptied.

The dispenser also comprises a dispensing head, which can be pressed by a user when the dispenser is in the operating configuration, operatively connected to the ring and equipped with a channel designed to collect the product at the outlet from the dosing chamber of the concertina-like deformable element through the openings of the ring in such a way as to dispense it through an outlet channel of the product.

Further features and advantages of the invention are more apparent in the non-limiting description which follows of a non-exclusive embodiment of a dispenser for dispensing a fluid.

BRIEF DESCRIPTION OF THE DRAWINGS

The description is set out below with reference to the accompanying drawings which are provided solely for purposes of illustration without restricting the scope of the invention and in which.

DESCRIPTION OF THE PREFERRED EMBODIMENTS

Figure 2:
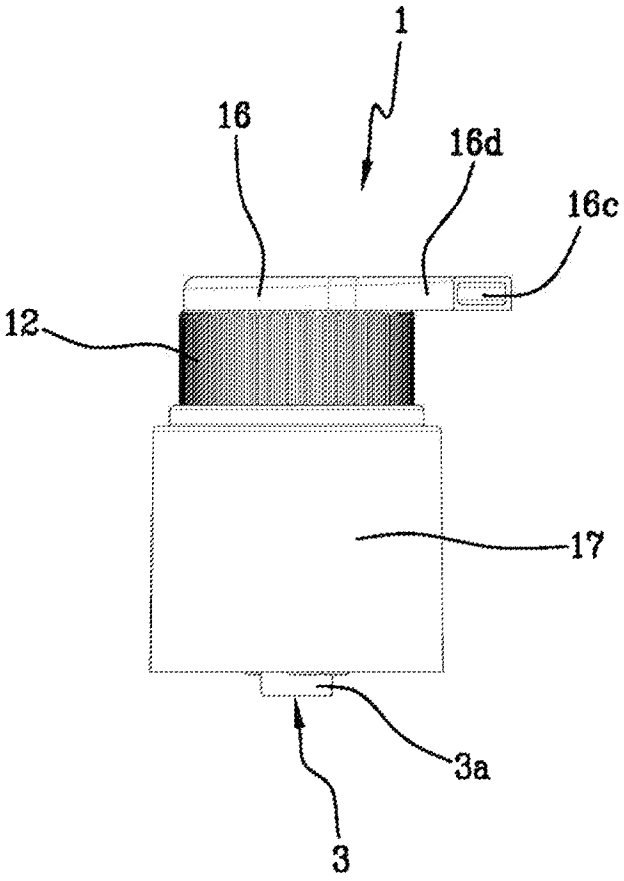
FIG. 2 is a schematic view of an outer view of the dispenser according to the invention.

With reference to the accompanying drawings, the numeral 1 denotes in its entirety a dispenser for dispensing a fluid which, for simplicity of description, will be referred to hereafter as the dispenser 1.

The dispenser 1 is made of plastic material in such a way as to simplify the recycling. Preferably, the dispenser 1 is made of polyethylene. Even more preferably, the plastic material is a biological plastic produced from non-fossil sources. In other words, the components from which the dispenser 1 is made are sized in such a way as to be made from a single plastic family (for example, polyethylene) so that it can also be recycled together with bottles which, when not transparent, are also made of polyethylene. Advantageously, in the polyethylene family there are the above-mentioned biological plastics (made from non-fossil sources) which are particularly recyclable and/or biodegradable.

The dispenser 1 comprises a ring nut 2 which can be screwed onto the neck of a bottle (not illustrated). The ring nut 2 is equipped with a coupling system preferably threaded. The accompanying drawings show the fastening system 2*a* made as a cylinder (defining the main body of the ring nut 2) equipped internally with a thread designed to allow the screwing to the neck of the bottle. The threaded fastening system 2*a* may be replaced by other coupling systems (not illustrated) for bottles.

The ring nut 2 has an orifice 3 for sucking the fluid. The orifice 3 is positioned in a central portion of the ring nut 2 and is designed to allow the coupling of the draw-up (not illustrated) for sucking the product from the bottle. Preferably, and as illustrated in the accompanying drawings, the orifice 3 is defined by a cylindrical element 3*a*.

The ring nut 2 also comprises a series of holes 4 positioned around the orifice 3 (that is, around the cylindrical element 3*a*). The holes 4 are made in such a way as to allow the passage of the compensation air, as described in detail below.

The ring nut 2 also comprises a cylindrical inner wall 5 coaxial with the cylindrical element 3*a* (that is, the orifice 3). In other words, the cylindrical wall 5 delimits the portion of the ring nut 2 having the orifice 3 and the holes 4. Preferably, as shown in the accompanying drawings, the orifice 3, the holes 4 and the cylindrical wall 5 are coaxial with each other. More specifically, the holes 4 are distributed on the perimeter of the orifice 3 and the cylindrical wall 5 surrounds and contains the orifice 3 (that is, the cylindrical element 3*a*) and the holes 4. The elements just described are positioned inside the walls of the main body of the ring nut 2 (which, as described above, have a substantially cylindrical shape).

The cylindrical wall 5 is also equipped with partial grooves 5*a* the function of which is described in detail below.

The ring nut 2 is also equipped with a flat annular portion 6 which connects the cylindrical wall 5 with the outer walls of the main body of the ring nut 2 equipped with the fastening system 2*a*. The flat annular portion 6 is designed to house a sealing gasket (not illustrated).

The dispenser 1 is also equipped with a concertina-like deformable element 7 defining a return spring of the dispenser 1.

The concertina-like deformable element 7 comprises a lower cylindrical projection 7*a* equipped with relative partial grooves 7*b*. The partial grooves 7*b* of the concertina-like deformable element 7 correspond to as many partial grooves 5*a* of the ring nut 2. In this way, in an operating configuration of the dispenser 1 (that is, a configuration designed to allow the actuation of the dispenser and the consequent dispensing of the product), the partial grooves 5*a* and 7*b* define a channel for the passage of the compensation air. On the other hand, when the dispenser is in a locked position, in which it is not possible to perform the actuation, the partial grooves 5*a* and 7*b* are offset in such a way as to close the passage channel and prevent the product from escaping from the inside of the bottle through the air infeed conduit.

The lower projection 7*a* is also equipped with a dome-shaped element 8 which rests on the orifice 3 forming an inlet valve for the product. Preferably, and as shown in the accompanying drawings, the dome-shaped element 8 is connected by wire-like elements 8*a* to a conical element 9 of the concertina-like deformable element 7. The combination of the thread-like elements 8*a* and the concertina-like deformable element 7 allow the dome-shaped element 8 to be correctly positioned relative to the orifice 3 of the ring nut 2 (that is, of the cylindrical element 3*a*).

The concertina-like deformable element 7 is also equipped with side walls 10 which define a dosing chamber 10*a* of the dispenser 1. The side walls 10 constitute deformable elements designed to define the return spring of the dispenser 1. In particular, the internal pressure of the dosing chamber 10*a* allows the control of the dome-shaped element 8 described above. More specifically, the dome-shaped element 8 is designed to rise in the case of negative pressures in the dosing chamber 10*a*. By opening, the dome-shaped element 8 allows the extraction of the product from the bottle.

The concertina-like deformable element 7 also comprises an upper portion 11 equipped with a sealing lip 11*a* designed to open in the case of a pressure of the dosing chamber 10*a* greater than a predetermined threshold value.

Preferably, the sealing lip 11*a* is configured to open when the pressure in the dosing chamber 10*a* exceeds a threshold value of between 400 and 600 mbar.

Even more preferably, the sealing lip 11*a* is configured to open when the pressure in the dosing chamber 10*a* exceeds a threshold value of 600 mbar.

The dispenser 1 is also equipped with a ring 12 positioned above the ring nut 2 and designed to define with the ring nut 2 a locking system designed to define an operating configuration and a non-operating configuration of the dispenser 1.

The term "operating configuration" means a configuration wherein the dispenser 1 can be actuated and is able to dispense the product drawn from the bottle.

The term "non-operating configuration" means a configuration wherein the dispenser 1 cannot be actuated and is therefore not able to dispense the product.

In particular, the ring 12 is able to define the two above-mentioned configurations by means of a reciprocal rotation between the ring 12 and the ring nut 2.

With reference to the locking system, it consists of inner axial ribs 13 positioned in an upper portion of the ring nut 2 and outer radial extensions 14 of the ring 12. The outer radial extensions 14 are located in a lower portion of the ring 12, close to the ring nut 2. In this way, in the non-operating configuration of the dispenser 1, the outer radial extensions 14 rest on the inner axial ribs 13 in such a way as to prevent operation of the dispenser 1.

The inner axial ribs 13 are distributed in such a way as to define channels 13*a* alternated with the inner axial ribs 13. The channels 13*a* are dimensioned in such a way as to allow a sliding of the outer radial extensions 14 of the ring 12. In the accompanying drawings the ring nut 2 is equipped with four inner axial ribs 13 and four channels 13*a* and the ring 12 is equipped with four outer radial extensions 14. In other words, a predetermined number of inner axial ribs 13 correspond to as many outer radial extensions 14 and channels 13*a* to guarantee the correct operation of the locking system for the actuation (or not) of the dispenser 1.

The ring 12 is hooked to the upper portion 11 of the concertina-like deformable element 7. The upper portion 11 of the concertina-like deformable element 7 is equipped with lateral grooves 11*b*. The grooves 11*b* are located in outer portions of the concertina-like deformable element 7 (where "outer" means that they are not facing the dosing chamber 10*a*) and are designed to allow the connection of the upper portion with the ring 12. In this way, rotating the ring 12 allows the transmission of the rotational motion to the concertina-like deformable element 7. In particular, the ring 12 is equipped with suitable ribs 12*d* designed to be inserted in the lateral grooves 11*b* of the concertina-like deformable element 7 in such a way as to allow the concertina-like deformable element 7 to be pulled during rotation.

In this way it is possible to pull the concertina-like deformable element 7 during the reciprocal rotation in such a way as to align or misalign the partial grooves 5*a* of the cylindrical wall 5 of the ring nut 2 and the partial grooves 7*b* of the concertina-like deformable element 7.

In this way, when the dispenser is in the operating configuration, the partial grooves 5*a* and 7*b* define the channel for passage of the compensation air defining a flow of air with the holes 4 of the ring nut 2 to obtain the compensation.

On the other hand, when the dispenser is in the non-operating configuration, the partial grooves 5*a* and 7*b* are not alongside each other and do not define the channel for the passage of the compensation air.

The ring 12 is also equipped with suitable openings 12*a* which, together with the sealing lip 11*a*, allow an outlet valve of the dispenser 1 to be made. In other words, the ring 12 is coupled to the upper portion 11 of the concertina-like deformable element 7 in such a way as to form, by means of the sealing lip 11*a* and the openings 12*a*, the outlet valve of the dispenser 1.

The ring 12 is preferably equipped with a flat flange 12*b* on which the openings 12*a* are formed and is also equipped with an inner dome 12*c* designed to reduce the dead volume of the dosing chamber 10*a*. At the base of the dome 12*c* there is a cylinder 15 which guarantees the correct position of the concertina-like deformable element 7 during assembly of the dispenser 1.

The ring 12 is also equipped with a first undercut 15*a* designed to allow the coupling of the concertina-like deformable element 7 and is equipped with extensions 15*d* made to prevent accidental closing of the passage of product during actuation of the dispenser 1.

The dispenser 1 is also equipped with a dispensing head 16 which can be pressed by a user when the dispenser 1 is in the operating configuration.

In particular, when the dispenser 1 is in the operating configuration, the actuation of the dispensing head 16 is allowed by the fact that the outer radial extensions 14 of the ring 12 can slide inside the channels 13*a* of the ring nut 2.

In the non-operating configuration, the outer radial extensions 14 rest on the inner axial ribs 13 in such a way as to prevent the actuation of the dispensing head 16.

The dispensing head 16 is operatively connected to the ring 12. In particular, the dispensing head 16 is equipped with an inner cylindrical projection 16*a* to which the ring 12 is coupled by means of a second undercut 15*b* of the ring 12. The dispensing head 16 is also equipped with a channel 16*b* designed to collect the product at the outlet from the dosing chamber 10*a* of the concertina-like deformable element 7 through the outlet valve (that is, through the openings 12*a* of the ring 12). As shown in the accompanying drawings, the channel 16 is made in the form of an annular channel. By collecting the product by the channel 16*b*, the dispenser 1 (that is, the dispensing head 16) is able to dispense the product through an outlet channel 16*c* of the product. The outlet channel 16*c* is made in the form of a spout 16*d*. Preferably, the spout 16*d* is a flexible spout designed to withstand removal of the dispensing head 16 due to impacts or other types of stresses.

Preferably, the dispensing head 16 rotates relative to the ring 12 with a minimum of rotation. Other configurations are possible wherein the dispensing head 16 is fixed relative to the ring 12.

The dispensing head 16 is also equipped with a sealing wall 16*e* designed to seal the dispensing head 16 keeping the two components stably coupled, further reducing the risk of accidental removal.

Figure 1:
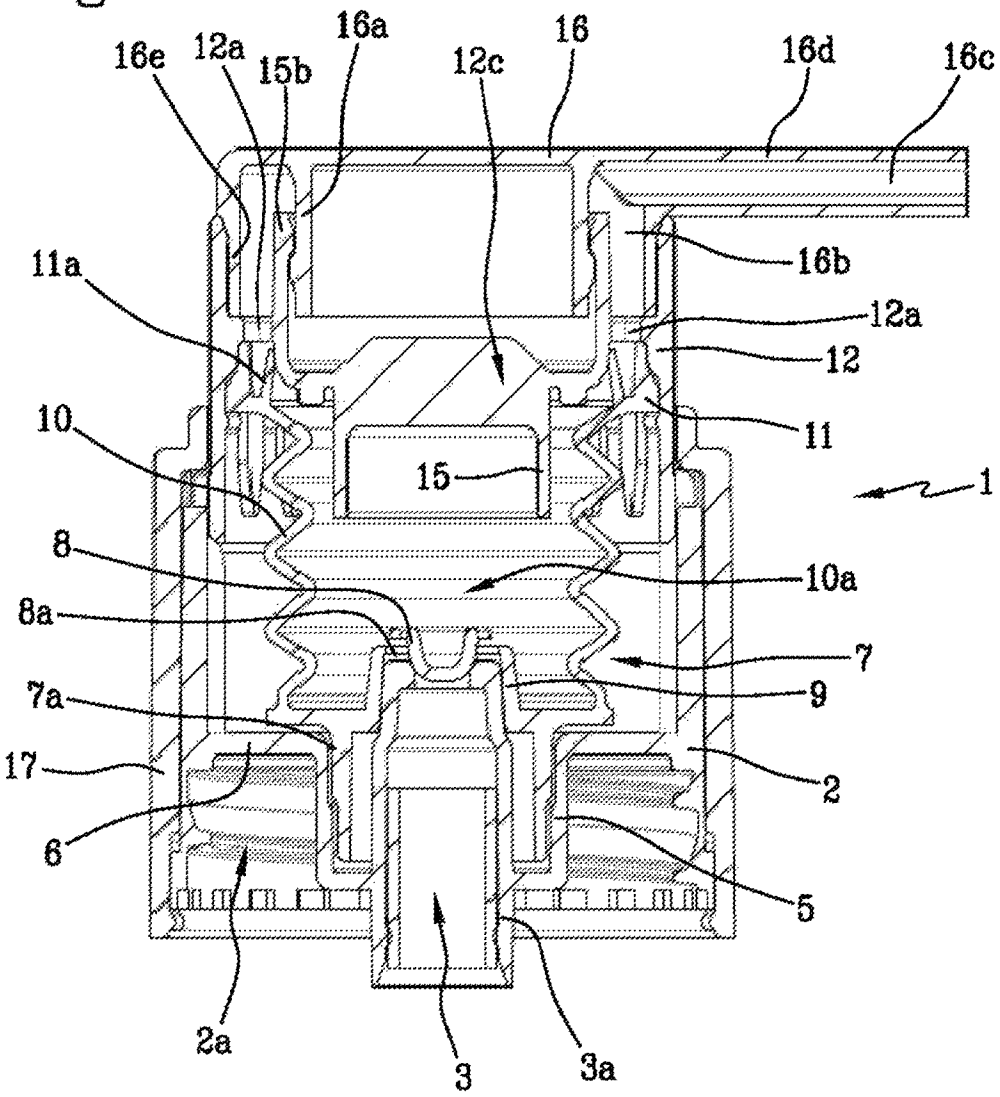
FIG. 1 is a schematic view of a transversal cross-section of a dispenser according to the invention.
Figure 3A:
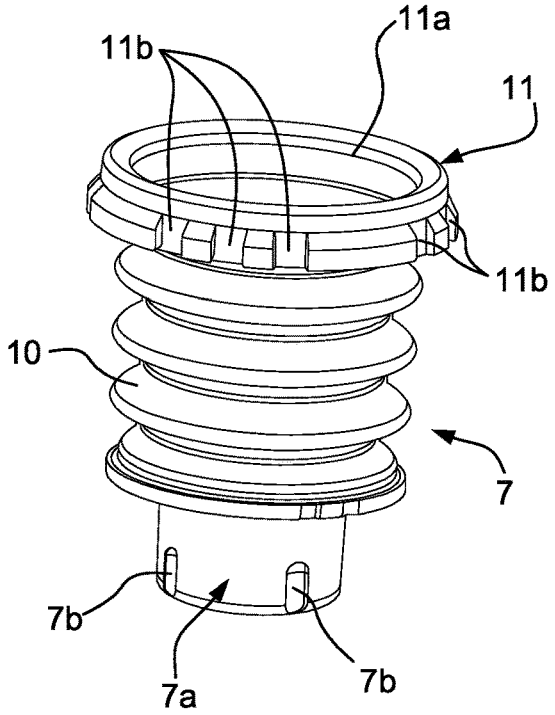
FIGS. 3*a* to 7 are illustrations of components of the dispenser of FIGS. 1 and 2 according to different embodiments.
Figure 3B:
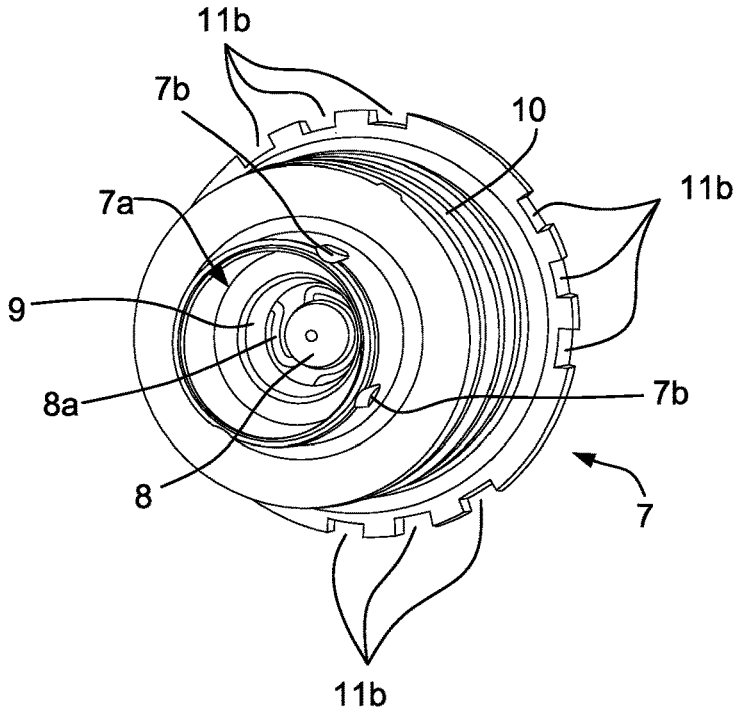
Figure 5:
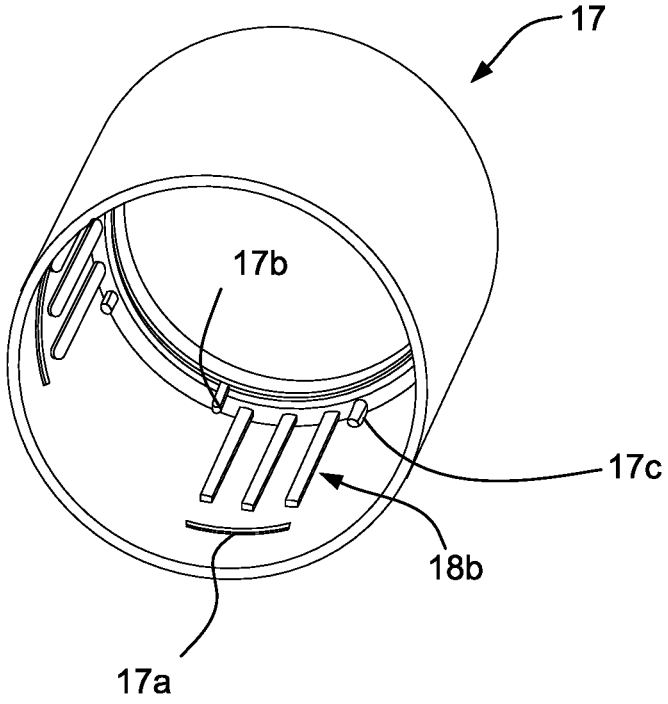
Figure 6A:
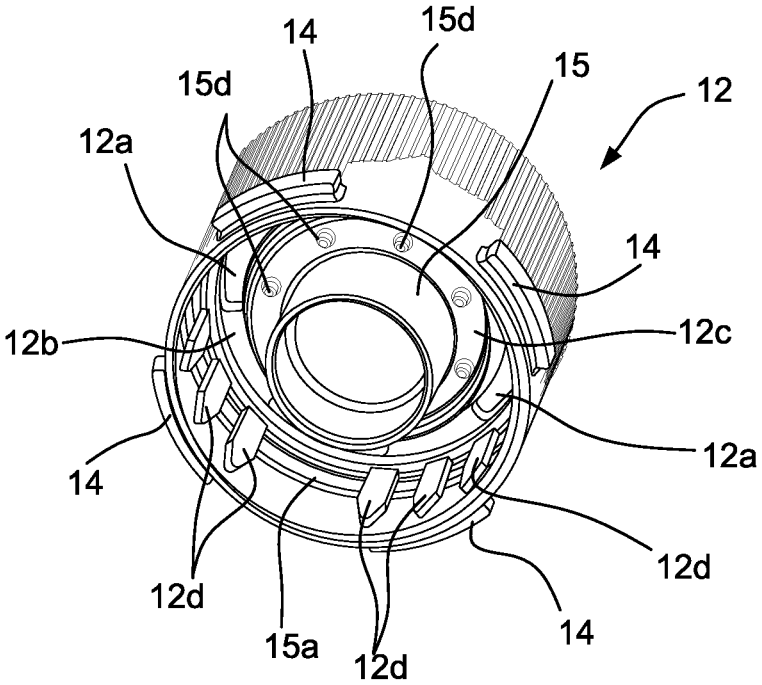
Figure 6B:
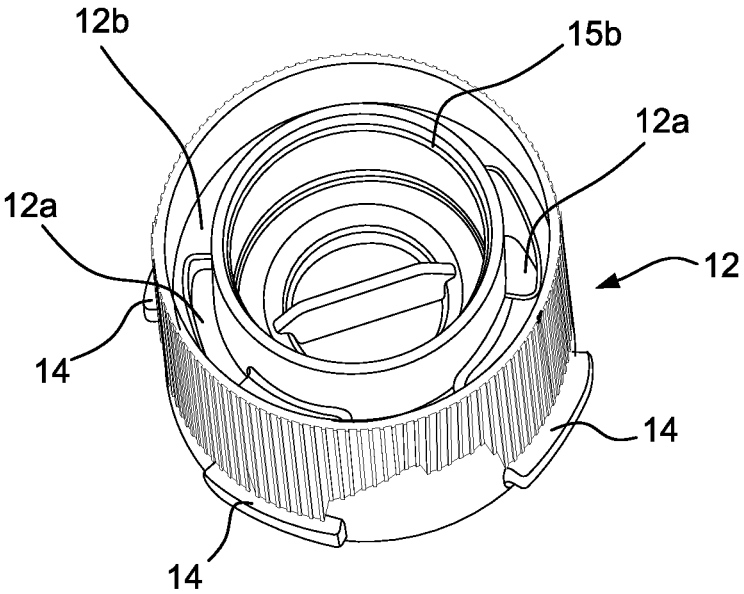
Figure 7:
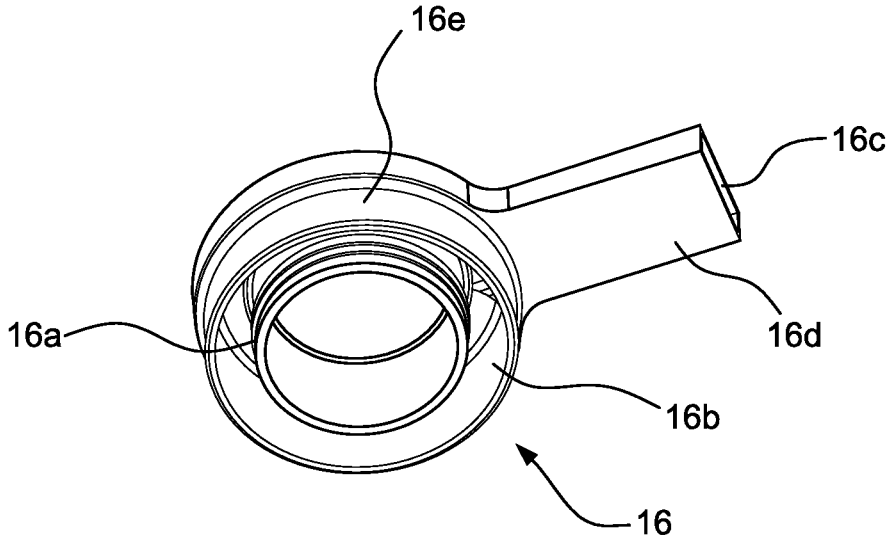

In the embodiment illustrated in FIGS. 1 and 2, with reference to the components of FIGS. 3*a*, 3*b*, 4*a*, 4*b*, 6*a*, 6*b* and 7, the dispenser 1 also comprises a collar 17 (shown in FIG. 5) connected to the ring nut 2 in such a way as to transmit the rotational motion. The collar 17 and the ring nut 2 are connected to each other by portions 18*a* and 18*b* shaped to match each other. The portions 18*a* and 18*b* have a mainly axial extension.

The collar 17 and the ring nut 2 are designed to define an end of stroke for the dispensing head 16. The collar 17 is also equipped with a relative undercut 17*a* (defined in a lower portion of the collar 17) designed to improve the connection between the collar 17 and the ring nut 2.

The collar 17 is preferably equipped with an end of stroke element 17*b* and suitable ribs 17*c* in an upper portion of it which, together with the portions 18*a* and 18*b* allow the sensitivity of the end of stroke for the dispensing head 16 to be defined, adjusting the maximum translation following the pressure by the user.

Figure 4A:
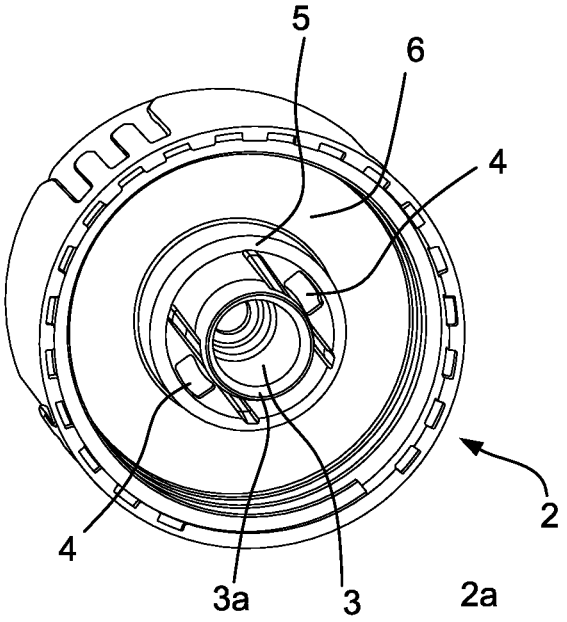
Figure 4B:
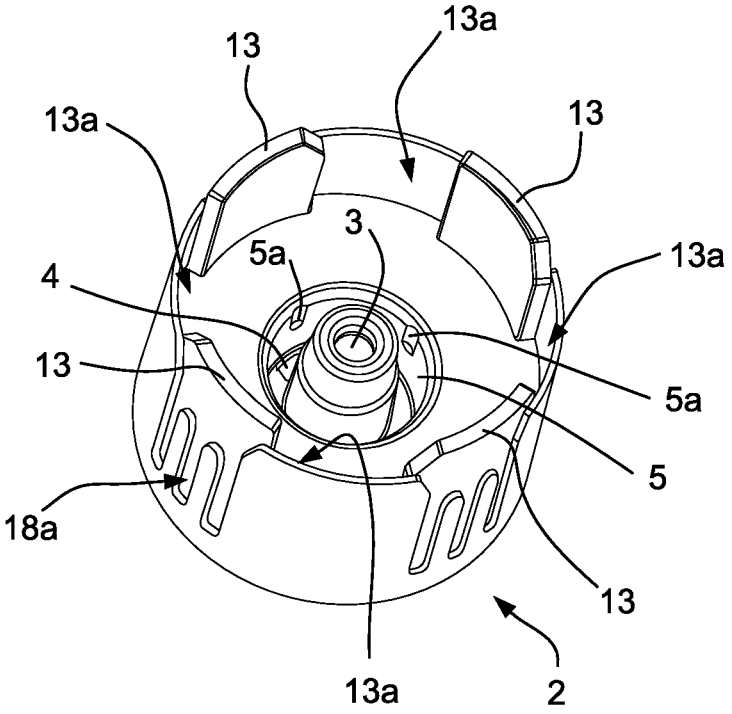
Figure 4C:
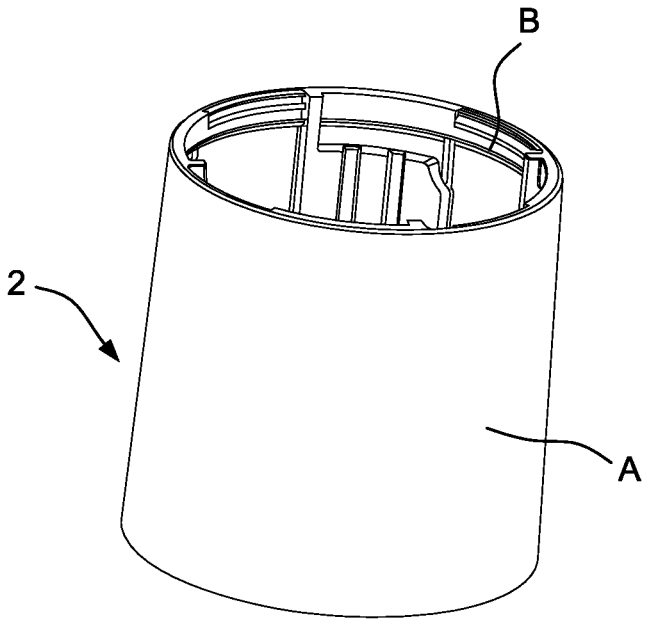

According to an embodiment not illustrated, the dispenser 1 may not be equipped with the collar 17. According to this embodiment, the ring nut 2 has the shape shown in FIG. 4*c*. In this shape, the ring nut 2 has a smooth (or knurled) outer wall "A" and an undercut "B" configured for retaining the dispensing head, thereby achieving the technical effects described above for the collar 17*a*.

In use, the actuation of the dispensing head 16 causes a deformation of the concertina-like deformable element 7 with consequent increase in the pressure inside the dosing chamber 10*a* which determines the dispensing of the product. In this context, the partial grooves 5*a* and 7*b* and the rest of the channels described above allow the selective passage of the air from the outside towards the inside of the bottle.

In other words, the particular structural shape of the concertina-like deformable element 7 and of the ring nut 2 is such that, once the dispenser 1 has been moved to the operating configuration, a duct is formed for compensating the air through which the air can pass inside the bottle in order to top-up the quantity of product coming out from the bottle following operation of the dispenser 1. In particular, the duct mentioned above is outside the dosing chamber 10*a* and is delimited between the walls 10 of the concertina-like deformable element 7 and by the ring nut 2 and the ring 12.

The path of the air flow is thus defined between the openings 12*a* and the series of holes 4 passing outside the concertina-like deformable element 7 and through the channel for the passage of the compensation air defined by the partial grooves 5*a* and 7*b*.

Advantageously, the dispenser 1 described above is able to overcome the drawbacks of the prior art.

Advantageously, the dispenser 1 described above allows a facilitated recycling due to the material with which the dispenser 1 is made.

Advantageously, the partial grooves 5*a* and 7*b* defining the channel for the passage of the compensation air allow the passage of air when the dispenser 1 is in the operating configuration.

In other words, even using a concertina-like deformable element 7, the dispenser 1 according to this invention is able to top-up the volume of product extracted.

Advantageously, the dispenser 1 according to the invention has strength properties such as to allow safe dispatch without the use of special protective devices.

The invention claimed is:

1. A dispenser (1) for dispensing a fluid contained in a bottle, made of plastic material, comprising:

a ring nut (2) which can be screwed on the neck of a bottle and having an orifice (3) for sucking fluid from the bottle, a series of holes (4) positioned around the orifice (3) and an inner cylindrical wall (5) equipped with partial grooves (5*a*);

a concertina-like deformable element (7), defining a return spring of the dispenser (1), comprising a lower cylindrical projection (7*a*) equipped with relative partial grooves (7*b*) and a dome-shaped element (8) which rests on the orifice (3) of the ring nut (2), and side walls (10) defining a dosing chamber (10*a*) of the dispenser (1), the dome-shaped element (8) constituting an inlet valve for the product and being designed to rise in the case of negative pressures of the dosing chamber (10*a*), the concertina-like deformable element (7) also comprising an upper portion (11) equipped with a sealing lip (11*a*) designed to open in the case of a pressure of the dosing chamber (10*a*) greater than a predetermined threshold value;

a ring (12) located on the ring nut (2) and designed to define with the ring nut (2) a locking system that defines a configuration of use and a non-operating configuration of the dispenser (1) by means of a reciprocal rotation of the ring (12) and the ring nut (2), the ring (12) also being hooked to the upper portion (11) of the concertina-like deformable element (7) i) so as to form, by means of the sealing lip (11A) and openings (12*a*) of the ring (12), an outlet valve of the dispenser (1), and ii) so as to pull the concertina-like deformable element (7) during the reciprocal rotation; and a dispensing head (16), which can be pressed by a user when the dispenser (1) is in the configuration of use, operatively connected to the ring (12) and equipped with a channel (16*b*) designed to collect the product at the outlet from the dosing chamber (10*a*) of the concertina-like deformable element (7) through the openings (12*a*) of the ring (12) for dispensing the product through an outlet channel (16*c*), wherein the reciprocal rotation of the ring (12) and the ring nut (2) makes possible to align the partial grooves (5*a*) of the cylindrical wall (5) of the ring nut (2) and the partial grooves (7*b*) of the concertina-like deformable element (7) when the dispenser is in the configuration of use, so that the partial grooves (5*a*, 7*b*) form, together with the series of holes (4), a channel for passage of compensation air which is distinct and separate from the conduit for dispensing the product formed by the orifice (3), from the dosing chamber (10*a*) and from the channels (16*b*, 16*c*) of the dispensing head.

2. The dispenser (1) according to claim 1, wherein, in the non-operating configuration of the dispenser (1), the partial grooves (7*b*) of the concertina-like deformable element (7) are offset relative to a same number of partial grooves (5*a*) of the ring nut (2), so that the channel for passage of the compensation air formed by the partial grooves (5*a*, 7*b*) together with the series of holes (4) is interrupted.

3. The dispenser (1) according to claim 2, wherein the upper portion (11) of the concertina-like deformable element (7) is also equipped with outer side grooves (11*b*) designed to allow connection of the upper portion (11) with the ring (12) and to allow the transmission of the rotational motion.

4. The dispenser (1) according to claim 2, wherein the dome-shaped element (8) is connected by wire-like elements (8*a*) to a conical element (9) of the concertina-like deformable element (7) configured to allow the correct positioning of the dome-shaped element (8) with the orifice (3) of the ring nut (2).

5. The dispenser (1) according to claim 2, wherein the sealing lip (11*a*) is configured for opening when the pressure in the dosing chamber (10*a*) exceeds a threshold value of between 400 and 600 mbar.

6. The dispenser (1) according to claim 2, wherein the locking system consists of inner axial ribs (13) positioned in an upper portion of the ring nut (2) and outer radial extensions (14) of the ring (12) so that, in the non-operating configuration of the dispenser (1), the outer radial extensions (14) rest on the inner axial ribs (13) and prevent actuation of the dispensing head (16).

7. The dispenser (1) according to claim 1, wherein the upper portion (11) of the concertina-like deformable element (7) is also equipped with outer side grooves (lib) designed to allow connection of the upper portion (11) with the ring (12) and to allow transmission of the rotational motion.

8. The dispenser (1) according to claim 7, wherein the dome-shaped element (8) is connected by wire-like elements (8*a*) to a conical element (9) of the concertina-like deformable element (7) configured to allow the correct positioning of the dome-shaped element (8) with the orifice (3) of the ring nut (2).

9. The dispenser (1) according to claim 7, wherein the sealing lip (11*a*) is configured for opening when the pressure in the dosing chamber (10*a*) exceeds a threshold value of between 400 and 600 mbar.

10. The dispenser (1) according to claim 1, wherein the dome-shaped element (8) is connected by wire-like elements (8*a*) to a conical element (9) of the concertina-like deformable element (7) configured to allow the correct positioning of the dome-shaped element (8) with the orifice (3) of the ring nut (2).

11. The dispenser (1) according to claim 10, wherein the sealing lip (11*a*) is configured for opening when the pressure in the dosing chamber (10*a*) exceeds a threshold value of between 400 and 600 mbar.

12. The dispenser (1) according to claim 1, wherein the sealing lip (11*a*) is configured for opening when the pressure in the dosing chamber (10*a*) exceeds a threshold value of between 400 and 600 mbar.

13. The dispenser (1) according to claim 12, wherein the threshold value is 600 mbar.

14. The dispenser (1) according to claim 1, wherein the locking system consists of inner axial ribs (13) positioned in an upper portion of the ring nut (2) and outer radial extensions (14) of the ring (12) so that, in the non-operating configuration of the dispenser (1), the outer radial extensions (14) rest on the inner axial ribs (13) and prevent actuation of the dispensing head (16).

15. The dispenser (1) according to claim 14, wherein the inner axial ribs (13) are distributed so as to define channels (13*a*) alternated to the inner axial ribs (13) and designed to allow a sliding of the outer radial extensions (14) of the ring (12) to allow the actuation of the dispensing head (16) in the operating configuration of the dispenser (1).

16. The dispenser (1) according to claim 1, further comprising:

a collar (17), connected to the ring nut (2) in a manner that transmits rotational movement, the collar (17) being connected to the ring nut (2) using portions (18*a*, 18*b*) which are shaped to match each other.

17. The dispenser (1) according to claim 16, wherein the collar (12) and the ring nut (2) are designed to define a limit stop for the dispensing head (16).

18. The dispenser (1) according to claim 1, wherein the outlet channel (16*c*) of the dispensing head (16) is made in the form of a flexible spout.

19. The dispenser (1) according to claim 1, wherein the plastic material is polyethylene.

20. The dispenser (1) according to claim 1, wherein the plastic material is a biological plastic produced from non-fossil sources belonging to the polyethylene family.

* * * * *